US005100446A

United States Patent [19]

Wisz

[11] Patent Number: 5,100,446

[45] Date of Patent: Mar. 31, 1992

[54] CRUDE NEON PRODUCTION SYSTEM

[75] Inventor: Michael W. Wisz, Tonawanda, N.Y.

[73] Assignee: Union Carbide Industrial Gases Technology Corporation, Danbury, Conn.

[21] Appl. No.: 637,688

[22] Filed: Jan. 7, 1991

[51] Int. Cl.[5] ..... F25J 3/04

[52] U.S. Cl. ..... 62/22; 55/66; 62/24; 62/42; 423/262

[58] Field of Search ..... 62/22, 24, 36, 42; 55/66; 423/262

[56] References Cited

U.S. PATENT DOCUMENTS

| | | | |
|---|---|---|---|
| 2,433,536 | 12/1947 | Van Nuys | 62/22 |
| 3,279,153 | 10/1966 | Basmadjian et al. | 55/66 |
| 3,430,418 | 3/1969 | Wagner | 55/25 |
| 3,609,984 | 10/1971 | Garwin | 62/22 |
| 3,616,602 | 11/1971 | Hays et al. | 55/66 |
| 3,838,553 | 10/1974 | Doherty | 55/58 |
| 3,963,462 | 6/1976 | Golovko et al. | 55/66 |
| 4,266,957 | 5/1981 | Isalski | 62/18 |
| 4,477,267 | 10/1984 | Reiss | 55/68 |
| 4,654,047 | 3/1987 | Hopkins et al. | 62/23 |
| 4,654,063 | 3/1987 | Auvil et al. | 62/18 |
| 4,834,780 | 5/1989 | Benkmann | 55/26 |

OTHER PUBLICATIONS

Kirk-Othmer Encyclopedia of Chemical Technology, Third Ed., vol. 12, John Wiley & Sons, 1980, Helium Group Gases, pp. 249-283.

*Primary Examiner*—Ronald C. Capossela
*Attorney, Agent, or Firm*—Stanley Ktorides

[57] ABSTRACT

A crude neon production system wherein a small neon-containing stream is taken from a cryogenic air separation plant and processed in a neon column and in a non-cryogenic pressure swing adsorption system to produce crude neon and wherein tail gas from the pressure swing adsorption is recycled back into the air separation plant.

18 Claims, 1 Drawing Sheet

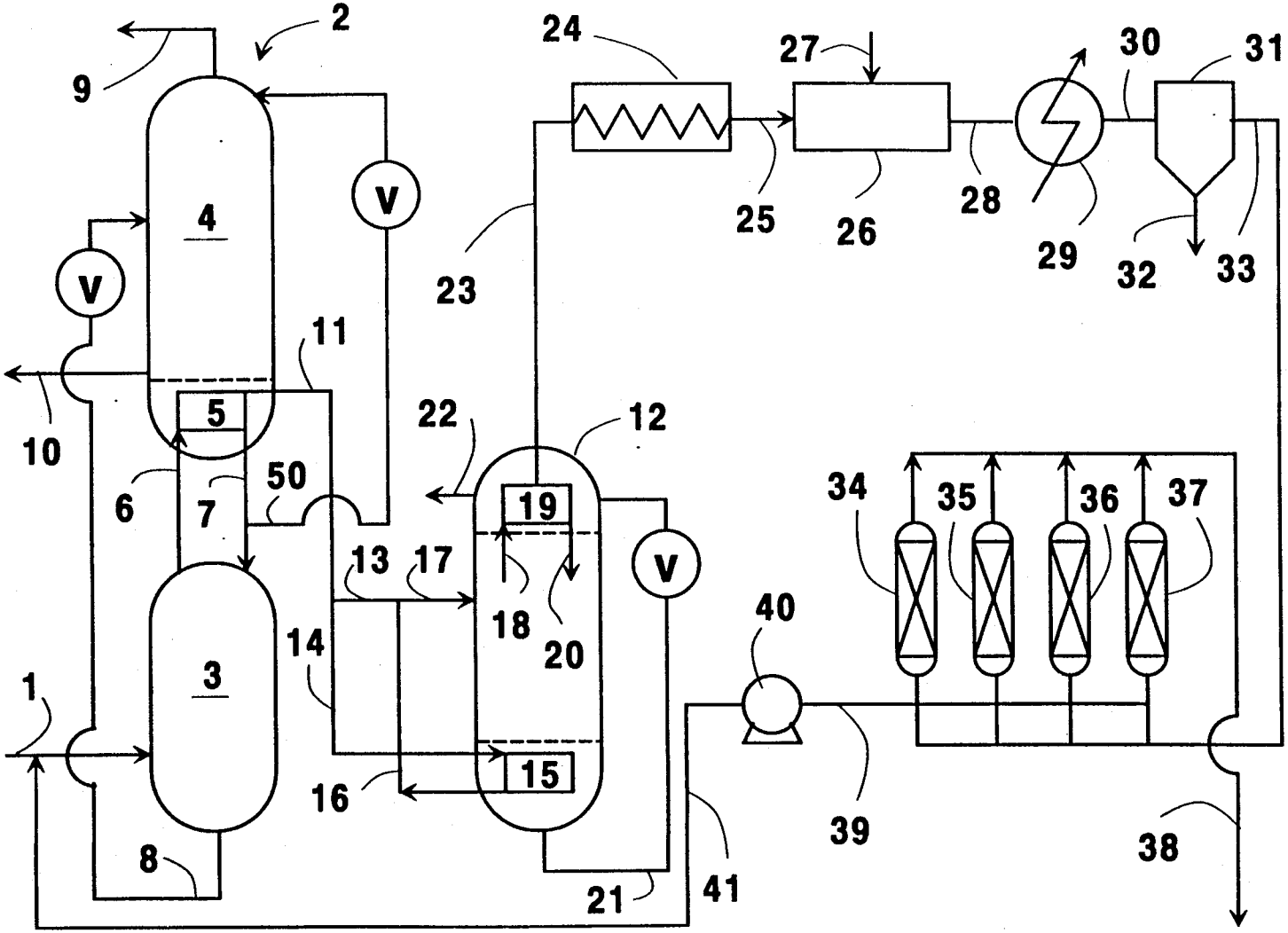
1
2
3
4
5
6
7
8
9
10
11
12
13
14
15
16
17
18
19
20
21
22
23
24
25
26
27
28
29
30
31
32
33
34
35
36
37
38
39
40
41
50
V
V
V

CRUDE NEON PRODUCTION SYSTEM

TECHNICAL FIELD

This invention relates generally to the production of neon by the separation of air into its component parts.

BACKGROUND ART

Neon is useful as a filling gas in lamps and luminous sign tubes. In addition, neon is used in airplane beacons because neon light can penetrate fog where other lights cannot.

Neon is produced by the cryogenic distillation of air wherein a stream from a cryogenic air separation plant is passed through a neon purification train including a neon column and a cryogenic adsorption system to produce a crude neon product which is then passed to a neon refinery to produce refined neon product. Neon is present in air in a concentration of about 18 parts per million (ppm). Because of this low concentration and also because the neon column and the cryogenic adsorption system require significant amounts of refrigeration to operate successfully, a relatively large flow from the cryogenic air separation plant must be taken in order to produce crude neon. This outflow from the air separation plant significantly burdens the plant and compromises its operation with respect to the production of the other components of air.

It is thus desirable to have a system which can produce crude neon from an air separation plant without burdening the air separation plant as much as do conventional crude neon production processes.

Accordingly, it is an object of this invention to provide a method for producing crude neon employing a cryogenic air separation plant while lessening the burden placed on the air separation plant by conventional crude neon production processes.

It is another object of this invention to provide an apparatus for producing crude neon employing a cryogenic air separation plant while lessening the burden placed on the air separation plant by conventional crude neon production processes.

SUMMARY OF THE INVENTION

The above and other objects which will become apparent to one skilled in the air upon a reading of this disclosure are attained by the present invention one aspect of which is:

A method for producing crude neon comprising:

(A) providing an air feed containing neon into an air separation plant and producing in the air separation plant by cryogenic rectification a first neon-containing fluid having a nitrogen concentration which exceeds that of the air feed and a neon concentration which exceeds that of the air feed;

(B) passing first neon-containing fluid from the air separation plant into a neon column and producing in the neon column a second neon-containing fluid having a nitrogen concentration which is less than that of the first neon-containing fluid and a neon concentration which exceeds that of the first neon-containing fluid;

(C) passing second neon-containing fluid through an adsorbent bed and preferentially adsorbing nitrogen on said bed to produce a crude neon product having a neon concentration which exceeds that of the second neon-containing fluid; and (D) desorbing the adsorbent bed at a pressure less than that at which the adsorption of step (C) is carried out and passing tail gas resulting from the desorption into the air separation plant.

Another aspect of the invention comprises:

Apparatus for producing crude neon comprising:

(A) an air separation plant;

(B) a neon column and means for providing fluid from the air separation plant into the neon column;

(C) an adsorption bed, mean to pass fluid from the neon column to the adsorption bed and means to recover crude neon product from the adsorption bed; and (D) means to desorb the adsorption bed to generate tail gas and means to pass tail gas from the adsorption bed into the air separation plant.

The term, "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column and/or, on packing elements. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al., page 13-3, *the Continuous Distillation Process.* The term double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will bend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeable termed rectification columns, distillation columns or fractionation columns.

As used herein the term "cryogenic rectification system" means an apparatus for carrying out vapor liquid countercurrent separation at a temperature below about 120° K and comprising at least one column.

As used herein the term "air separation plant" means a cryogenic rectification system wherein air is a feed.

As used herein the term "neon column" means a cryogenic rectification system wherein a feed comprising neon and nitrogen is separated to produce a fluid richer in neon.

As used herein the term "tail gas" means neon-containing gas desorbed from an adsorption separation unit.

BRIEF DESCRIPTION OF THE DRAWING

The sole FIGURE is a simplified schematic representation of one preferred embodiment of the crude neon production system of this invention.

DETAILED DESCRIPTION

The invention will be described in detail with reference to the Drawing.

Referring now to the FIGURE, feed air 1, which has been compressed, cleaned of high boiling impurities such as water and carbon dioxide, and cooled is provided into cryogenic air separation plant 2. The equipment including the feed air compressor, prepurifier and heat exchangers which normally comprise the warm end portion of the plant are not shown in the FIGURE. In the embodiment illustrated in the FIGURE, the air separation plant is a double column system comprising a higher pressure column 3 and a lower pressure column 4 in heat exchange relation at main condenser 5. Feed air 1 is provided into higher pressure column 3 which is operating at a pressure generally within the range of from 70 to 150 pounds per square inch absolute (psia). Within column 3 the feed air is separated by cryogenic rectification into nitrogen-richer and oxygen-richer components. The nitrogen-richer component is passed as vapor 6 into main condenser 5 wherein it is condensed by indirect heat exchanger with reboiling column 4 bottoms. Resulting condensed nitrogen-richer component 7 is returned to column 3 as reflux.

Oxygen-richer component is passed from column 3 as liquid stream 8 into column 4 which is operating at a pressure less than that of column 3 and generally within the range of from 15 to 25 psia. In addition a portion 50 of stream 7 is expanded and introduced into column 4. Within column 4 the feeds are separated into nitrogen which is removed as stream 9 and into oxygen which is removed as stream 10. Either or both of these streams may be recovered as product.

Because neon has a boiling point which is significantly less than that of nitrogen, the neon in the feed air concentrates at the top of the higher pressure column and is passed with stream 6 into main condenser 5. As the vapor in stream 6 condenses in main condenser 5, the remaining uncondensed vapor at the top part of main condenser 5 grows progressively richer in neon, along with other low boiling components of the air such as hydrogen and helium. First neon-containing fluid is taken from main condenser 5 as vapor stream 11 and passed as feed into neon column 12 at a flowrate within the range of from 0.1 to 1.0 percent of the flowrate of the air feed into the air separation plant. Preferably main condenser 5 is a differential type condenser. First neon-containing fluid 11 has a neon concentration which exceeds that of the air feed and generally the neon concentration of the first neon-containing fluid will be within the range of from 0.2 to 2.0 percent.

In the embodiment illustrated in the FIGURE, stream 11 is divided into first portion 13 which is provided directly into neon column 12, and into second portion 14 which is passed into bottom reboiler 15. In reboiler 15 second portion 14 is cooled by indirect heat exchange with boiling neon column bottoms so as to provide vapor boilup for the neon column. The resulting stream 16 is recombined with stream 13 and combined stream 17 passed into neon column 12.

Within neon column 12 the first neon-containing fluid is separated by cryogenic rectification into a vapor enriched in neon and a liquid enriched in nitrogen. The vapor is passed 18 into top reflux condenser 19 wherein it is condensed and returned 20 as reflux for column 12. Liquid 21 is provided from the bottom of neon column 12 and expanded into the boiling side of reflux condenser 19 and boils to carry out the aforementioned condensation of vapor 18. Resulting gaseous nitrogen 22 is passed out from column 12.

A portion of vapor 18 does not condense in top reflux condenser 19 and in this vapor portion there is concentrated the neon which was provided into neon column 12 with the first neon-containing fluid. Also concentrated in this vapor are low boiling components of air such as hydrogen and helium.

Stream 23 is passed out from top condenser 19 as second neon-containing fluid having a nitrogen concentration which is less than that of the first neon-containing fluid and a neon concentration which exceeds that of the first neon-containing fluid. The nitrogen concentration of second neon-containing fluid 23 will generally be within the range of from 10 to 30 percent and the neon concentration of second neon-containing fluid 23 will generally be within the range of from 50 to 65 percent. The remainder of second neon-containing fluid is composed primarily of helium and hydrogen.

The embodiment illustrated in the FIGURE is a preferred embodiment wherein hydrogen is removed from the second neon-containing fluid prior to its passing through the adsorbent bed. In this embodiment stream 23 is heated through heater 24 and heated stream 25 is provided into catalytic reactor 26 along with oxygen 27. Generally the catalyst in catalytic reactor 26 is a palladium catalyst. Within catalytic reactor 26 the oxygen and hydrogen react in an exothermic reaction to form water. Stream 28 is taken from catalytic reactor 26, cooled through cooler 29 and passed 30 through separator 31 wherein condensed water is removed 32. The resulting second neon-containing fluid 33 is then passed through the adsorbent bed.

The adsorbent bed useful with this invention comprises adsorbent which preferentially adsorbs nitrogen over neon. Preferably the adsorbent is molecular sieve such as type 5A zeolite.

The second neon-containing fluid is passed through the adsorbent bed at an elevated pressure generally within the range of from 60 to 140 psia. At this elevated pressure the nitrogen is preferentially adsorbed over neon onto the bed resulting in the production of a crude neon product containing substantially no nitrogen. Of course, some neon is also adsorbed by the adsorbent bed. The crude neon product will have a neon concentration within the range of from 70 to 80 percent with the remainder being substantially all helium. The nitrogen concentration in the crude neon product will generally be less than 50 ppm. An advantage of the invention is that the adsorbent bed operates at a pressure generally the same as that of the column system and thus additional compression equipment is not necessary.

Preferably the adsorbent bed also contains activated carbon, with molecular sieve occupying the top half of the adsorbent bed and activated carbon occupying the bottom half of the adsorbent bed. When catalytic hydrogen removal is carried out as was described above, the second neon-containing fluid provided into the adsorbent bed will additionally contain oxygen and water vapor. The oxygen results from excess oxygen being provided into the catalytic reactor in order to ensure that the hydrogen is completely removed. The water vapor results from incomplete condensation of water vapor in the catalytic reactor effluent. The activated carbon serves to adsorb the water vapor and to chemisorb the oxygen so that the crude neon product contains substantially no oxygen or water vapor.

In addition some oxygen is also adsorbed by the molecular sieve adsorbent. The oxygen concentration in the crude neon product will generally be less than 50 ppm.

The resulting crude neon product is then recovered and passed to a neon refinery for the production of product grade neon having a neon purity of 99.99 percent or more.

The adsorbent bed is desorbed at a pressure less than that at which the aforesaid adsorption is carried out. Generally the desorption is carried out at a pressure within the range of from 3 to 14 psia. Preferably the ratio of the pressure during the adsorption, or adsorption pressure, to the pressure during the desorption, or desorption pressure, is within the range of from 7 to 20. The low pressure desorption may be carried out by means of a vacuum pump on a line connected to the bed.

The tail gas resulting from the desorption of the adsorbent bed contains substantially all of the nitrogen which was in the second neon-containing fluid. Generally the nitrogen concentration in the tail gas is within the range of from 40 to 60 percent. The tail gas will also contain some neon, generally at a concentration within the range of from 30 to 50 percent and may also contain oxygen, water vapor and helium. The tail gas is passed from the adsorbent bed into the air separation plant.

The embodiment illustrated in the FIGURE is a particularly preferred embodiment wherein four adsorption beds are employed so that at least one bed is undergoing adsorption while another is undergoing desorption so as to provide a more uniform product flow.

Referring back now to the FIGURE, second neon-containing fluid 33 is passed into one of four adsorbent beds 34, 35, 36 and 37. While that bed is undergoing the adsorption the other three beds are undergoing depressurization, desorption or repressurization respectively. The flow through the beds is controlled by appropriate valves and timers which are not shown. The crude neon product is taken as stream 38 while the tail gas is taken as stream 39. Vacuum pump 40 serves to desorb the appropriate adsorbent bed and to flow the tail gas 41 back to the air separation plant. As illustrated in the FIGURE, the tail gas may be passed into the air separation plant combined with the air feed. Preferably the tail gas is passed into the intake of the air feed compressor which is not shown in the FIGURE but is at the start of the warm end portion of the plant.

The adsorption step of this invention is carried out at a temperature generally about ambient. Cryogenic adsorption is avoided and the refrigeration requirements of the invention are reduced over that of conventional systems. The flow from the air separation plant into the neon column can be significantly less than in conventional practice. This improves the overall performance of the air separation plant and, furthermore, enables the production of crude neon product having a nitrogen presence at much lower levels than is possible with conventional systems. A small amount of liquid nitrogen may be added to the neon column to supplement the refrigeration provided with the feed into the neon column from the air separation plant.

The tail gas recycle to the air separation plant serves to signficantly increase the overall neon recovery. By use of the invention, neon which would otherwise have been lost, is recycled back to the air separation plant and ultimately recovered as crude neon. In this way, by use of the invention, crude neon product may be produced with significantly improved efficiency over that attainable with conventional systems.

Although the invention has been described in detail with reference to a certain preferred embodiment, those skilled in the art will recognize that there are other embodiments of the invention within the spirit and the scope of the claims.

I claim:

1. A method for producing crude neon comprising:

(A) providing an air feed containing neon into an air separation plant and producing in the air separation plant by cryogenic rectification a first neon-containing fluid having a nitrogen concentration which exceeds that of the air feed and a neon concentration which exceeds that of the air feed;

(B) passing first neon-containing fluid from the air separation plant into a neon column and producing in the neon column a second neon-containing fluid having a nitrogen concentration which is less than that of the first neon-containing fluid and a neon concentration which exceeds that of the first neon-containing fluid;

(C) passing second neon-containing fluid through an adsorbent bed and preferentially adsorbing nitrogen on said bed to produce a crude neon product having a neon concentration which exceeds that of the second neon-containing fluid; and (D) desorbing the adsorbent bed at a pressure less than that at which the adsorption of step (C) is carried out and passing tail gas resulting from the desorption into the air separation plant.

2. The method of claim 1 wherein the flowrate of the first neon-containing fluid from the air separation plant into the neon column is within the range of from 0.1 to 1.0 percent of the flowrate of the air feed into the air separation plant.

3. The method of claim 1 wherein the concentration of neon in the first neon-containing fluid is within the range of from 0.2 to 2.0 percent.

4. The method of claim 1 wherein the concentration of neon in the second neon-containing fluid is within the range of from 50 to 65 percent.

5. The method of claim 1 wherein the concentration of neon in the crude neon product is within the range of from 70 to 80 percent.

6. The method of claim 1 wherein the adsorption of step (C) is carried out at a pressure within the range of from 60 to 140 psia.

7. The method of claim 1 wherein the desorption of step (D) is carried out at a pressure within the range of from 3 to 14 psia.

8. The method of claim 1 wherein the ratio of the pressure during the adsorption to the pressure during the desorption is within the range of from 7 to 20.

9. The method of claim 1 wherein the second neon-containing fluid further comprises hydrogen, further comprising providing oxygen to the second neon-containing fluid and reacting oxygen with hydrogen to form water vapor.

10. The method of claim 9 further comprising adsorbing water vapor on the adsorbent bed.

11. Apparatus for producing crude neon comprising:

(A) an air separation plant;

(B) a neon column and means for providing fluid from the air separation plant into the neon column;

(C) an adsorption bed, mean to pass fluid from the neon column to the adsorption bed and means to recover crude neon product from the adsorption bed; and (D) means to desorb the adsorption bed to generate tail gas and means to pass tail gas from the adsorption bed into the air separation plant.

12. The apparatus of claim 11 wherein the air separation plant is a double column plant having a main condenser.

13. The apparatus of claim 12 wherein the means for providing fluid from the air separation plant into the neon column passes from the main condenser.

14. The apparatus of claim 11 wherein the adsorbent bed comprises molecular sieve.

15. The apparatus of claim 11 wherein the adsorbent bed comprises molecular sieve and activated carbon.

16. The apparatus of claim 11 further comprising a catalytic reactor positioned between the neon column and the adsorption bed.

17. The apparatus of claim 11 wherein the means to desorb the adsorption bed comprises a vacuum pump.

18. The apparatus of claim 11 comprising four adsorption beds sequentially connected so that at least one bed is undergoing adsorption while at least one bed is undergoing desorption.

* * * * *